United States Patent [19]

Michetti

[11] 4,413,769

[45] Nov. 8, 1983

[54] CARTON WITH INTERNAL PARTITION

[75] Inventor: Louis C. Michetti, Santa Clara, Calif.

[73] Assignee: Container Corporation of America, Chicago, Ill.

[21] Appl. No.: 415,147

[22] Filed: Sep. 7, 1982

[51] Int. Cl.[3] ..... B65D 5/48

[52] U.S. Cl. ..... 229/27; 206/494; 221/45; 221/62; 229/15; 229/37 R

[58] Field of Search ..... 229/15, 27, 37 R, 38; 221/45-55, 61-63, 33; 206/233, 494, 561, 565, 554

[56] References Cited

U.S. PATENT DOCUMENTS

| | | | |
|---|---|---|---|
| 2,983,421 | 5/1961 | Turpin | 229/27 X |
| 3,048,321 | 8/1962 | Sanford | 229/27 |
| 3,195,772 | 7/1965 | Buttery | 221/33 |
| 3,482,734 | 12/1969 | Mierson | 221/63 |
| 3,503,494 | 3/1970 | Blatz et al. | 206/494 |
| 3,583,597 | 6/1971 | Buttery | 206/494 X |
| 3,625,411 | 12/1971 | Cote | 229/37 R |
| 4,260,059 | 4/1981 | Roccaforte | 229/27 X |

FOREIGN PATENT DOCUMENTS

| | | | |
|---|---|---|---|
| 987270 | 4/1976 | Canada | 229/27 |
| 1443111 | 7/1976 | United Kingdom | 206/494 |

*Primary Examiner*—William Price
*Assistant Examiner*—Gary E. Elkins
*Attorney, Agent, or Firm*—Richard W. Carpenter; Davis Chin

[57] ABSTRACT

A collapsible folding carton having an integral, internal partition joined to the bottom wall and one end wall and being free from attachment to other walls of the carton.

11 Claims, 8 Drawing Figures

CARTON WITH INTERNAL PARTITION

BACKGROUND OF THE INVENTION

1. Field of the Invention

This invention relates generally to folding cartons, and more particularly to a one-piece, paperboard folding carton having an integral, internal partition panel spaced from the top wall of the carton to permit the insertion therebetween of a plurality of sheets of packaged material such as facial tissues.

2. Description of the Prior Art

A prior art search in the U.S. Patent and Trademark Office directed to the subject matter of this application disclosed the following U.S. Pat. Nos.: 2,142,808; 2,431,131; 2,983,421; 3,048,321; 3,185,373; 3,195,772; 3,235,163; 3,369,700; 3,370,776; 3,456,842; 3,583,597; 4,231,491.

None of the prior art patents uncovered in the search disclosed a collapsible folding carton having an integral, internal partition panel which is foldably joined along bottom and end edges to bottom and end wall panels of the carton and which has its other edges free from attachment to the carton.

SUMMARY OF THE INVENTION

An object of the invention is to provide a new and improved type of collapsible folding carton adapted for use in dispensing sheets of packaged material such as facial tissues.

Another object of the invention is the provision, in a carton of the type described, of an integral, internal partition having end and bottom edges attached to end and bottom walls of the carton and having its other edges free from attachment to the carton.

A more specific object of the invention is the provision, in a carton of the type described, of a partition panel having an upper edge spaced from the top wall of the carton to permit the insertion between the partition and the top wall of the carton of a plurality of sheets of packaged material.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
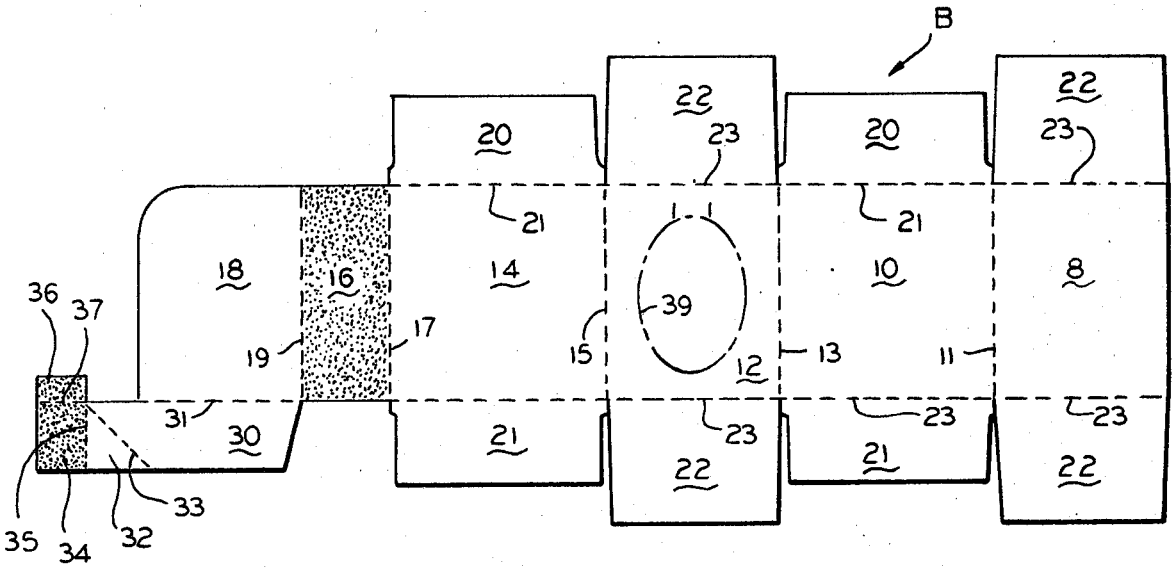
FIG. 1 is a plan view of a blank of foldable sheet material from which carton embodying features of the invention and illustrated in the other views may be formed.
Figure 6:
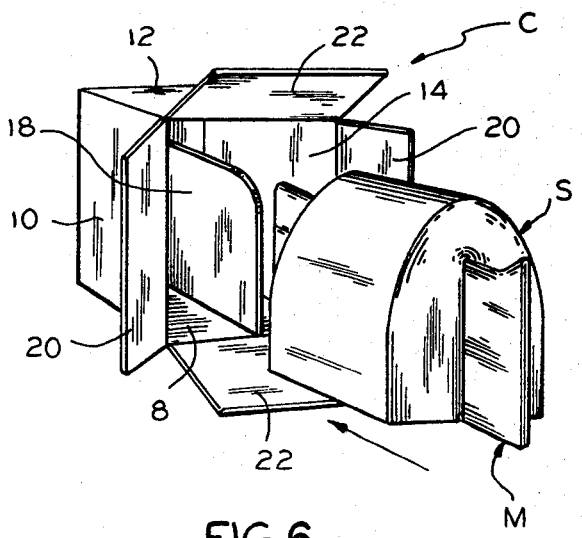
Figure 8:
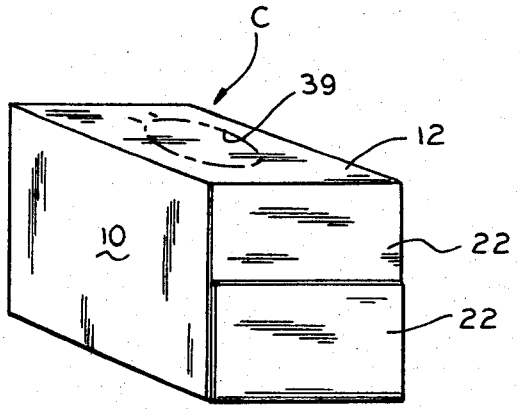
FIG. 8 is a perspective view of a carton, embodying features of the invention, which has been filled and closed.

Referring now to the drawings for a better understanding of the invention, and particularly to FIGS. 1, 6, and 8, it will be seen that the novel carton C, which may be formed from a unitary blank B of foldable sheet material illustrated in FIG. 1, includes an internal partition panel 18 adapted to receive a plurality of sheets of packaged articles, such as tissues indicated generally at T, which may be draped over the partition panel or, if desired, draped over a separate mandrel M which, in turn, may be positioned over the internal partition panel 18.

Again referring now to FIG. 1 of the drawings, it will be seen that the body portion of the blank B includes the following panels as seen from right to left: bottom wall panel 8, first side wall panel 10, top wall panel 12, second side wall panel 14, connecting panel 16, and partition panel 18, which are foldably joined to each other along parallel fold lines 11, 13, 15, 17, and 19, respectively.

Connecting panel 16 is adhesively secured to the upper surface of bottom wall panel 8 to form the body of the carton which is a tubular structure open at the ends. The ends of the structure may be closed in a conventional manner by opposed pairs of inner and outer closure flaps 20 and 22, which are foldably joined along fold lines 21 and 23 to opposite end edges of the end wall panels and the top and bottom wall panels, respectively.

Still referring to FIG. 1, it will be seen that an anchor panel 30 is foldably joined along one edge on fold line 31 to an end edge of partition panel 18. A generally triangular gusset panel 32 is foldably joined on fold line 33 to one end of anchor panel 30 and is foldably joined along another fold line 35 to one edge of a first glue flap 34. A second glue flap 36 is foldably joined to another edge of first glue flap 34 along a fold line 37, which is aligned with but spaced from fold line 31 which connects anchor panel 30 to partition panel 18.

Figure 2:
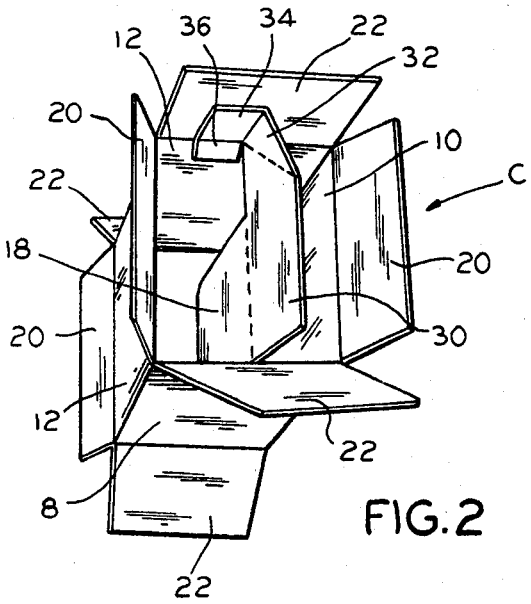
FIGS. 2, 3, and 4 are fragmentary perspective views of one end of a carton formed from the blank illustrated in FIG. 1, illustrating various steps in closing the end of the carton.
Figure 3:
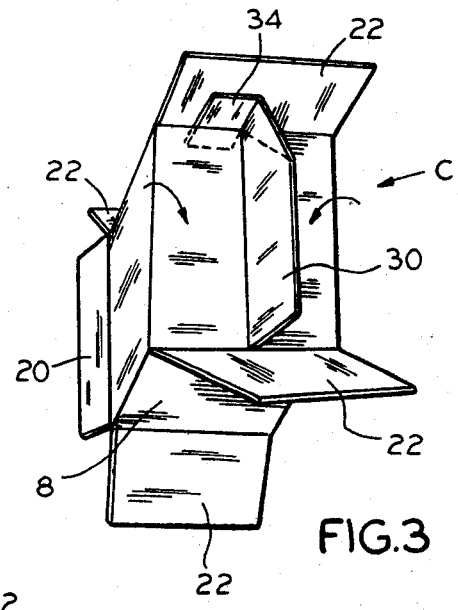
Figure 4:
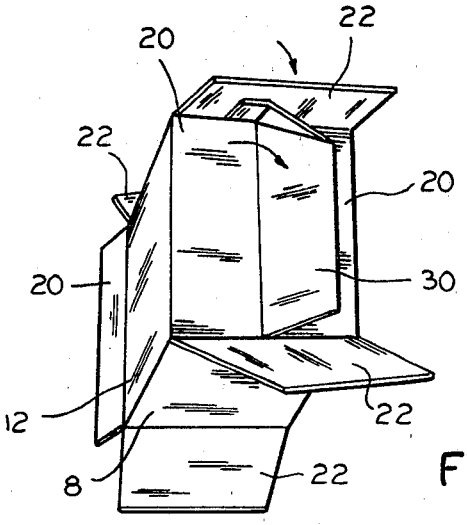
Figure 5:
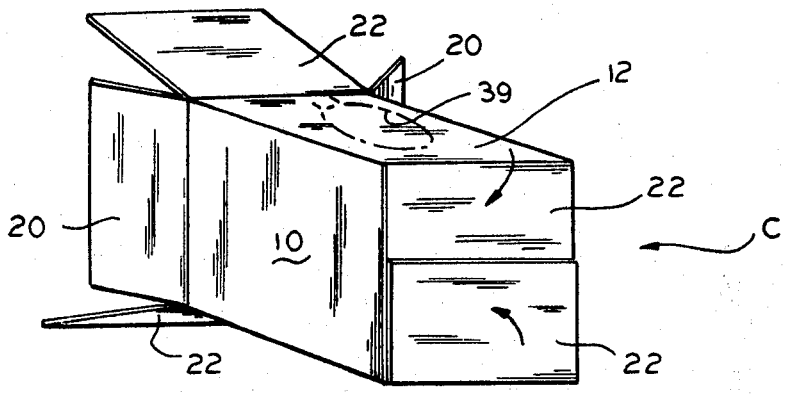
FIGS. 5, 6, and 7 are views similar to FIGS. 2, 3, and 4, but illustrate the opposite end of the carton and show the manner in which the product is loaded into the carton and the carton is closed.

Turning now to FIGS. 2, 3, and 4 of the drawings it will be seen that, to close one end of the carton after it has been erected, the inner closure flaps 20 are folded into the carton first, as seen in FIG. 3. At this time anchor panel 30, gusset panel 32, and first and second glue flaps 34 and 36 are post-outside of the inner closure flaps 20, with the first glue flap 34 being adhesively secured to an inside surface of the top outer closure flap 22 and with the second glue flap 36 being adhesively secured to the inside surface of the top wall panel 12.

The anchor and gusset panels are then folded over into face-to-face relation with an outer surface of one of the inner closure panels 20, and then the outer closure flaps are folded over the anchor panel, gusset panel and inner closure flaps to close the end of the carton.

Figure 7:
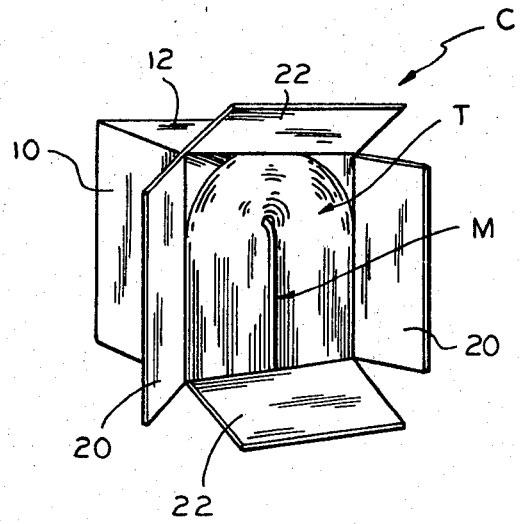

Now referring to FIGS. 6 and 7, it will be seen that the novel partition panel is attached only at one end edge and the bottom edge to the end and bottom walls of the carton, with the other end edge and the upper edge being entirely free from attachment to the carton. This permits the loading of the carton by either draping the packaged articles, such as sheets of tissue, over the partition panel of, if desired, draping them over a separate mandrel, indicated generally at M, which can be positioned over the partition panel. After this has been done the other end of the carton can be closed and the outer closure flaps sealed to the inner closure flaps in a conventional manner.

The top wall of the carton may be provided with a cut line 39 which permits a section of the top wall panel to be removed to provide an opening for dispensing articles from the carton.

What is claimed is:

1. A collapsible folding carton with an integral, internal partition, said carton being formed from a unitary blank of foldable paperboard and comprising:

(a) pairs of opposed top and bottom wall panels and side wall panels foldably joined to each other to form a tubular structure open at the ends;

(b) end walls, for closing each end of said tubular structure, each including opposed pairs of closure flaps foldably joined to end edges of said top and bottom wall panels and said side wall panels and adapted to be secured to each other in overlapped relation;

(c) an integral partition panel positioned within said tubular structure intermediate said side wall panels and parallel thereto;

(d) said partition panel:

(i) having a lower edge foldably joined to said bottom wall panel;

(ii) having one end edge, which is generally normal to said lower edge, foldably joined to one of said end walls;

(iii) having its other edges free from attachment to said carton.

2. A carton according to claim 1, wherein said partition panel is foldably joined to said bottom wall panel through a connecting panel which is adhesively secured to an inner surface of said bottom wall panel.

3. A carton according to claim 1, wherein each of said end walls includes:

(a) a pair of inner closure flaps foldably joined to end edges of respective side wall panels;

(b) a pair of outer closure flaps foldably joined to end edges of respective top and bottom wall panels.

4. A carton according to claim 3, wherein said partition panel one end edge is foldably joined to a related end wall outer closure flap.

5. A carton according to claim 4, wherein said partition panel is foldably joined to said related end wall outer flap by means of:

(a) an anchor panel foldably joined to said partition panel one end edge;

(b) a glue flap secured to an inside surface of said relation outer closure flap;

(c) a gusset panel foldably joined along one end to said anchor panel and along another edge to said glue flap and being interposed therebetween.

6. A carton according to claim 5, and including another glue flap foldably joined to an edge of said first mentioned glue flap and being adhesively secured to an inside surface of said top wall panel.

7. A carton according to claim 5, wherein said anchor panel, said gusset panel, and said glue flap are sandwiched between said end wall inner and outer closure flaps.

8. A carton according to claim 1, wherein said partition panel has an upper edge spaced below said top wall panel a distance sufficient to permit the insertion, between said partition panel and said top wall panel, of a plurality of sheets of packaged material.

9. A carton according to claim 1, wherein said top wall panel has a detachable section located over said partition panel for providing a dispensing opening in said carton.

10. A blank of foldable sheet material, such as paperboard, for use in forming a carton having an integral, internal partition, said blank being cut and scored to provide:

(a) a top wall panel;

(b) a pair of side wall panels foldably joined to opposite side edges of said top wall panel;

(c) a bottom wall panel foldably joined to a side edge of one of said side wall panels;

(d) a connecting panel foldably joined to a side edge of the other of said side wall panels;

(e) a partition panel foldably joined at a side edge to a side edge of said connecting panel;

(f) an anchor panel foldably joined along one edge to an end edge of said partition panel along a first fold line;

(g) a gusset panel foldably joined at one edge to another edge of said anchor panel along a second fold line which forms an acute angle with said first fold line;

(h) a glue flap foldably joined at one edge to another edge of said gusset panel along a third fold line that extends in a direction normal to said first fold line.

11. A blank according to claim 10, and including another glue flap foldably joined at one edge to another edge of said first mentioned glue flap along a fourth fold line that is aligned with but spaced from said first fold line.

* * * * *